United States Patent [19]

Geringer et al.

[11] Patent Number: 4,986,581

[45] Date of Patent: Jan. 22, 1991

[54] ELECTROMAGNETIC DOOR LOCK DEVICE

[76] Inventors: Arthur Geringer, 5029 E. Jacobs Ct., Agoura, Calif. 91301; Richard Geringer, 2663 Riata Ct., Camarillo, Calif. 93010; David Geringer, 28364 Balkin, Agoura, Calif. 91301

[21] Appl. No.: 509,453

[22] Filed: Apr. 16, 1990

[51] Int. Cl.[5] ..... E05C 17/56

[52] U.S. Cl. ..... 292/251.5; 292/DIG. 72; 292/144

[58] Field of Search ..... 292/251.5, 144, DIG. 4, 292/DIG. 38, DIG. 72, 73

[56] References Cited

U.S. PATENT DOCUMENTS

| | | | |
|---|---|---|---|
| 3,204,995 | 9/1965 | Teeter | 292/251.5 |
| 3,221,375 | 12/1965 | Lewis et al. | 292/251.5 X |
| 3,260,788 | 7/1966 | Stetson | 292/251.5 X |
| 3,350,127 | 10/1967 | Hekeloor | 292/251.5 |
| 3,360,970 | 1/1968 | Hays, Jr. | 292/144 X |
| 3,468,576 | 9/1969 | Beyer et al. | 292/251.5 |
| 3,794,336 | 2/1974 | Graham . | |
| 4,257,631 | 3/1981 | Logan, Jr. | 292/251.5 |
| 4,401,346 | 8/1983 | Jones et al. | 292/144 |
| 4,439,808 | 3/1984 | Gillham | 292/144 |
| 4,487,439 | 12/1984 | McFadden | 292/251.5 |
| 4,652,028 | 3/1987 | Logan et al. | 292/251.5 |
| 4,826,223 | 5/1989 | Geringer et al. | 292/251.5 |

*Primary Examiner*—Richard E. Moore
*Attorney, Agent, or Firm*—John J. Posta, Jr.

[57] ABSTRACT

An improvement in an electromagnetic door device. The door device includes an electromagnet secured in a housing to the underside of the top of a door frame, a door hinged in the frame for opening and closing therein, and an armature secured to the top of the door for movement betrween a resting position on the door top and an operative position upwardly magnetically attracted to the electromagnet when the latter is energized. In the operative position, the armature is intercepted by a locking plate depending from the housing, so as to lock the door until the electromagnet is deenergized and the armature drops away to the resting position. The improvement is a device which biases the armature upwardly so that it is, in effect, lighter, requiring less electromagnetic force to attract it and permitting the armature to be spaced, in the resting position, a greater distance therefrom for improved door-frame clearance. The biasing device may be one or more leaf or coil springs, elastomeric cushions or plugs or mutually repelling permanent magnets disposed between the adjacent surfaces of the armature and door top. The armature can also be honeycombed to reduce its weight.

10 Claims, 1 Drawing Sheet

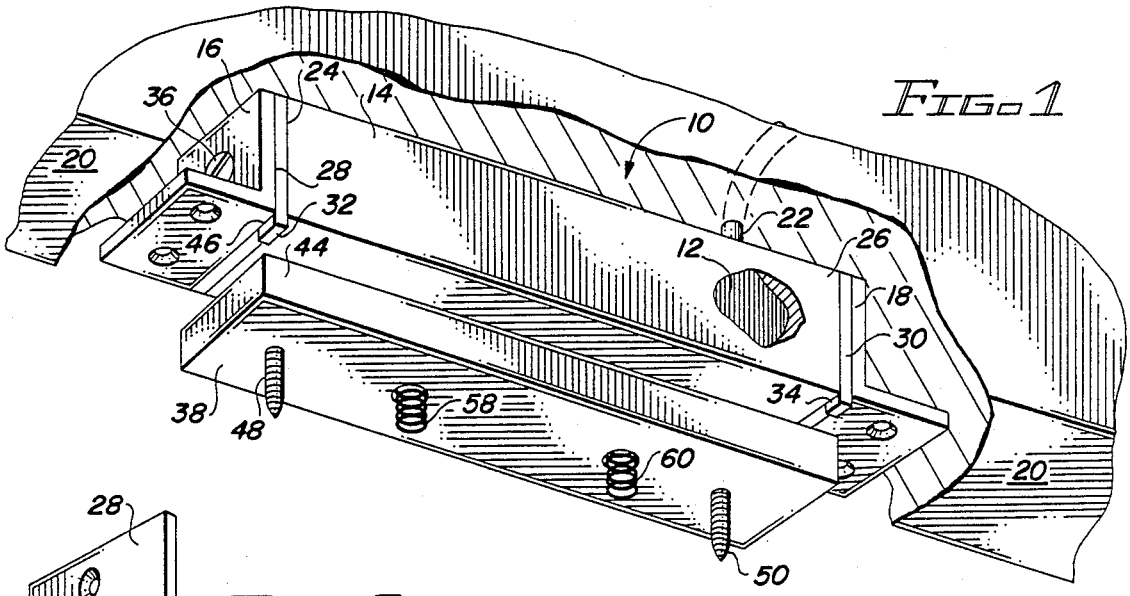
FIG. 1
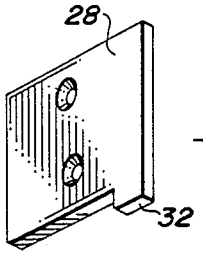
FIG. 2
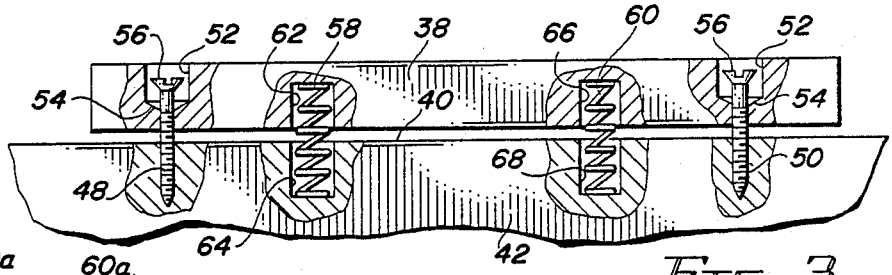
FIG. 3
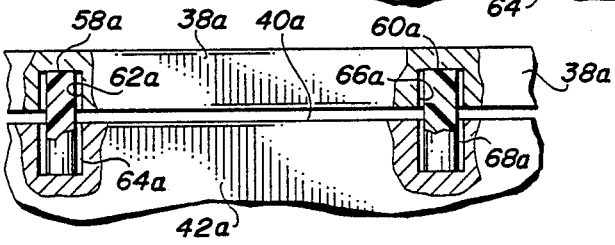
FIG. 4
FIG. 5
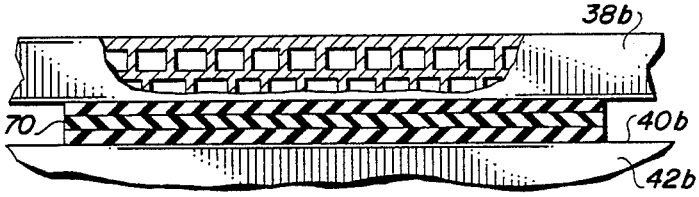
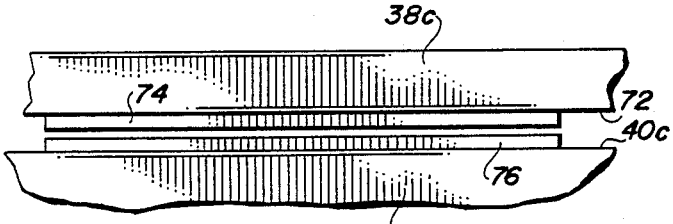
FIG. 6
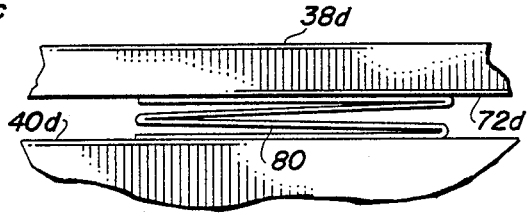
FIG. 7

ELECTROMAGNETIC DOOR LOCK DEVICE

BACKGROUND OF THE INVENTION

1. FIELD OF THE INVENTION

The present invention generally relates to locking devices and more particularly to an improvement in an electromagnetic door lock device:

2. PRIOR ART

Various types of door lock devices have been devised in the past. Certain of such devices are electromagnetic and a few of these employ an electromagnet connected to the top of a door frame and a movable armature connected to the top of a door in the frame. Difficulties with proper tolerances and clearances in use and with durability when and if an attempt is made to force the locked door open have resulted in an improvement in the form of the device claimed in U.S. Pat. No. 4,826,223 which utilizes a shear lock plate easily replaced if door forcing occurs and not an integral part of the electromagnet housing which otherwise would become damaged by such forcing. The plate allows some adjusting of spacing and tolerances.

However, there remains a need for a further improvement which will permit further door frame-door clearance while still permitting full operation of the device, in order to compensate for any door and/or frame irregularities. Such an improvement should be durable, efficient, inexpensive and capable of being utilized in a variety of forms.

SUMMARY OF THE INVENTION

The improved biasing means of the present invention satisfies all the foregoing needs. The electromagnetic device comprises an electromagnet in a housing secured to the underside of a door frame, an armature connected to the door top and movable from a resting position on the door top and an operative position magnetically attracted up toward the energized electromagnet, and a shear plate depending from the housing and intercepting the armature in the operative position to lock the door. Such biasing means comprises one or more leaf or coil springs, elastomeric plugs or cushions or mutually repelling permanent magnets positioned between the adjacent surfaces of the armature and the door top. In one embodiment, the coiled spring or elastomeric plug is disposed in aligned pockets in those adjacent surfaces.

Not only is the armature resiliently biased upwardly toward the electromagnet in the housing connected to the underside of the door frame for easier movement toward the electromagnet when the latter is energized, but the armature is cushioned above the door top so as not to strike it and clatter and so as not to deform either the armature or door top. Irregularities in the adjacent two components remain spaced from each other. In addition, the armature spacing from the electromagnet can be increased for better frame-door clearance because of the increased ease of movement of the armature toward the electromagnet when the latter is energized. Such ease of movement can be further improved by honeycombing the armature rather than having it in the form of a solid heavy strip of metal.

Further advances of the improvement of the present invention are set forth in the following detailed description and accompanying drawings.

DRAWINGS

FIG. 1 is a schematic side and bottom perspective view of a first preferred embodiment of the present biasing improvement in a first preferred embodiment of the electromagnetic door lock device;

FIG. 2 is a schematic side perspective view of the shear lock plate of the device of FIG. 1;

FIG. 3 is an enlarged fragmentary schematic side elevation, partly broken away and partly in section, of the armature of FIG. 1 and the adjoining door top bearing the biasing improvement of FIG. 1;

FIG. 4 is an enlarged, fragmentary schematic side elevation of a second preferred embodiment of the armature and door top of the electromagnetic lock device bearing a second preferred embodiment of the biasing improvement of the present invention;

FIG. 5 is an enlarged, fragmentary, schematic side elevation of a third preferred embodiment of the armature and door top of the electromagnetic lock device bearing a third preferred embodiment of the biasing improvement of the present invention;

FIG. 6 is an enlarged, fragmentary, schematic side elevation of a fourth preferred embodiment of the armature and door top of the electromagnetic lock device bearing a fourth prefered embodiment of the biasing improvement of the present invention; and FIG. 7 is an enlarged, fragmentary, schematic side elevation of a fifth preferred embodiment of the armature and door top of the electromagnetic lock device bearing a fifth preferred embodiment of the biasing improvement of the present invention.

DETAILED DESCRIPTION

FIGS. 1–3

A first preferred embodiment of the biasing improvement of the present invention is schematically depicted in FIGS. 1 and 3 disposed in a first preferred embodiment of the present electromagnetic door lock device.

Thus, device 10 is shown which comprises an electromagnet 12 disposed in a hollow rectangular housing 14 connected by L-shaped brackets 16 and 18 to the underside of a door frame 20. Electromagnet is connected by electrical conduit 22 to a remote electrical power source (not shown) such as "house current".

Disposed between brackets 16 and 18 and the adjacent ends 24 and 26, respectively, of housing 14 are shear plates 28 and 30 bearing rear depending tabs 32 and 34, respectively. Screws 36 hold the respective brackets and shear plates to the housing ends.

Device 10 includes an elongated flat metal armature 38 connected to the top surface 40 of a door 42 (FIG. 3) hinged in frame 20 directly under housing 14 when door 42 is closed in frame 20. Armature 38 is movable between a resting position directly above and adjacent to surface 40, as shown in FIG. 3, and an operative position wherein the rear 44 of armature 38 is directly in front of and about abuts the front 46 of tabs 32 and 34. Armature 38 automatically moves into the described operative when electromagnet 12 is energized and attracts armature 38 to housing 14. In this position, door 42 is locked in place by armature 38 and tabs 32 and 34 until electromagnet 12 is deenergized and armature 38 drops to its resting position shown in FIG. 3.

This movement of armature 38 is facilitated by the manner in which armature 38 is connected to surface 40. Thus, armature 38 has a pair of wide headed screws 48 and 50 seated in open topped wide pockets 52 with narrow bottoms 54, screws 48 and 50 extending down therethrough and out the bottom of armature 38. Screws 48 and 50 are threaded into surface 40. Upward movement of armature 38 is limited by heads 56 of screws 48 and 50 striking narrow bottoms 54. Thus, armature 38 will not fall off of surface 40.

The improvement of the present invention is shown in a first preferred embodiment in FIG. 3, as a pair of coiled springs 58 and 60 of steel, other metal or plastic disposed in adjoining and aligned pockets in armature 38 and surface 40. Thus, spring 58 bridges the adjacent surfaces of armature 38 and door 42 and is disposed in aligned pockets 62 and 64 therein. Similarly, spring 60 is disposed in aligned pockets 66 and 68. Springs 58 and 60 are long enough so that when armature 38 is in the resting position of FIG. 3 it does not touch surface 40 but is buoyed up by springs 58 and 60, enabling it to be more easily attracted to electromagnet 12 when the latter is energized. This, in turn, allows armature 38 and top surface 40 to be positioned farther below housing 14, allowing more clearance between frame 20 and armature 38. Moreover, since armature 38 in the resting position is held above surface 40, armature 38 does not clatter thereon when electromagnet 12 is deenergized and armature 38 drops toward surface 40. Neither armature 38 nor surface 40 is damaged and neither need be smooth and perfectly regular.

FIG. 4

A second preferred embodiment of the biasing improvement of the present invention is schematically depicted in FIG. 4. Thus, a spaced pair of vertical elastomeric rubber or plastic plugs **58*a* and 60*a* substituted for springs 58 and 60 in sets of pockets 62*a* and 64*a*, and 66*a* and 68*a*, in armature 38*a* and top surface 40*a* of door 42*a*, with comparable results to those obtained with springs 58 and 60**.

FIG. 5

A third preferred embodiment of the biasing improvement of the present invention is schematically depicted in FIG. 5. Thus, the biasing improvement comprises a multi-ply stack 70 of elastomeric foam material of plastic or rubber attached to either armature **38*b* or surface 40*b* in place of coils 58 and 60 and plugs 58*a* and 60. No coil or plug pockets are present in armature 38*b* and top surface 40*b* of door 42*b***.

In addition, armature **38*b* is of honeycombed metal rather than the solid metal plate of armatures 38 and 38*a*. This is to lighten armature 38*b*** and making it easier to move into the operative position.

FIG. 6

A fourth preferred embodiment of the biasing improvement of the present invention is schematically depicted in FIG. 6. Thus, armature **38*c* is shown bearing on its lower surface 72*a* permanent magnet 74. Top surface 40*c* of door 42*c* bears a similar permanent magnet 76 of opposite polarity to that of magnet 74 so that magnets 74 and 76 mutually repel each other and keep armature 38*c* well above surface 40*c* in the resting position as shown in FIG. 6**. This substitutes for the coils, plugs and pads previously described.

FIG. 7

A fifth preferred embodiment of the biasing improvement of the present invention is schematically depicted in FIG. 7. Such biasing improvement comprises a leaf spring 80 mounted on lower surface **72*d* of armature 38*d* or on top surface 40*d* of door 42*d*** in place of the coiled springs, plugs, pad and magnets previously described.

The biasing embodiments of FIGS. 1–7 are generally similar in function and effects. Moreover, components bearing similar numerals in the various figures are similar, except as described.

Various other modifications, changes, alterations and additions can be made in the biasing improvement of the present invention as used in the electromagnetic door lock device, and in the components and parameters thereof. All such modifications, changes, alterations and additions as are within the scope of the appended claims form part of the present invention.

What is claimed is:

1. In an electromagnetic door lock device having an electromagnet secured in a housing to the underside of the top of a door frame, a door hinged in said frame for opening and closing, an armature moveably secured to the top of the door below said housing and magnetically attractable up towards said electromagnet to an operative position when the latter is energized, said armature dropping by gravity toward said door frame top to a resting position when said electromagnet is deenergized, and door locking means connected to and depending from said housing which intercepts said armature only when the latter is in said operative position magnetically attracted to said energized electromagnet, so as to prevent said door from opening, the improvement which comprises means which biases said armature upwardly toward said operative position so as to reduce the amount of magnetically attractive force needed to move said armature to said operative position.

2. The improvement of claim 1 wherein said biasing means is disposed between the adjacent surfaces of said armature and said door top.

3. The improvement of claim 2 wherein said biasing means comprises at least one spring.

4. The improvement of claim 3 wherein said spring is a leaf spring secured to one of said adjacent surfaces.

5. The improvement of claim 3 wherein said spring is a coil spring disposed in aligned pockets in said adjacent surfaces.

6. The improvement of claim 2 wherein said biasing means is an elastomeric plug disposed in aligned pockets in said adjacent surfaces.

7. The improvement of claim 2 wherein said biasing means is an elastomeric pad secured to one of said adjacent surfaces.

8. The improvement of claim 2 wherein said biasing means are a part of permanent magnets exhibiting mutually repelling force and connected to said adjacent surfaces facing each other.

9. The improvement of claim 1 wherein said armature is honeycombed so as to reduce its effective weight.

10. An electromagnetic door lock device comprised of:

(a) an electromagnet adapted to be secured to the top of a door frame, (b) an armature adapted to be movably secured to the top of a door; and (c) means to bias said armature upwardly toward said electromagnet so as to reduce the amount of attractive force needed to move said armature into contact with said electromagnet.

* * * * *